United States Patent [19]

Lippincott, deceased

[11] 4,005,612

[45] Feb. 1, 1977

[54] PRELOADED ANTI-RATTLE DEVICE

[75] Inventor: Leander H. Lippincott, deceased, late of Middletown, Conn., by Dorothy M. Lippincott, executrix

[73] Assignee: United Technologies Corporation, Hartford, Conn.

[22] Filed: Oct. 31, 1975

[21] Appl. No.: 628,161

[52] U.S. Cl. ..... 74/470; 74/99 R; 74/531; 403/120; 403/149

[51] Int. Cl.[2] ..... G05G 1/00

[58] Field of Search ..... 74/522.5, 470, 469, 74/531, 99 R, 110; 244/42 DA, 42 DB; 188/83; 403/120; 415/145

[56] References Cited

UNITED STATES PATENTS

| | | | |
|---|---|---|---|
| 445,946 | 2/1891 | Cary | 403/120 |
| 3,948,467 | 4/1976 | Krusius | 74/110 X |

*Primary Examiner*—Samuel Scott
*Assistant Examiner*—F. D. Shoemaker
*Attorney, Agent, or Firm*—Charles A. Warren

[57] ABSTRACT

An anti-rattling device which also preloads the actuated device and includes a link supporting and guiding the actuated device, with the anti-rattling mechanism including a resilient roller positioned to engage a cam surface on the link, the cam surface being eccentric to a pivot point for the link.

7 Claims, 2 Drawing Figures

PRELOADED ANTI-RATTLE DEVICE

BACKGROUND OF THE INVENTION

In devices subject to vibration, any looseness permits rattling with resultant wear. Elimination of such rattling to minimize wear is desirable but must be obtainable by a simple device, easy to assemble and dependable in operation.

SUMMARY OF THE INVENTION

The present invention involves a resilient pressure device that will serve to maintain a load on the pivot point or points where looseness may occur so as to prevent rattling without however increasing the actuating forces to move the mechanism involved.

According to the invention an actuated device is guided in its movement by one or more links pivoted to the device, with a resilient roller mounted to engage an external surface of the link adjacent its pivot point, the external surface being eccentric to the pivot point of the link. The eccentric surface is arranged to compress the roller more and more as the actuated device is moved toward inoperative position, such that the effect of the roller is to urge the actuated device into operative position.

The foregoing and other objects, features, and advantages of the present invention will become more apparent in the light of the following detailed description of preferred embodiments thereof as illustrated in the accompanying drawing.

DESCRIPTION OF THE PREFERRED EMBODIMENT

Figure 1:
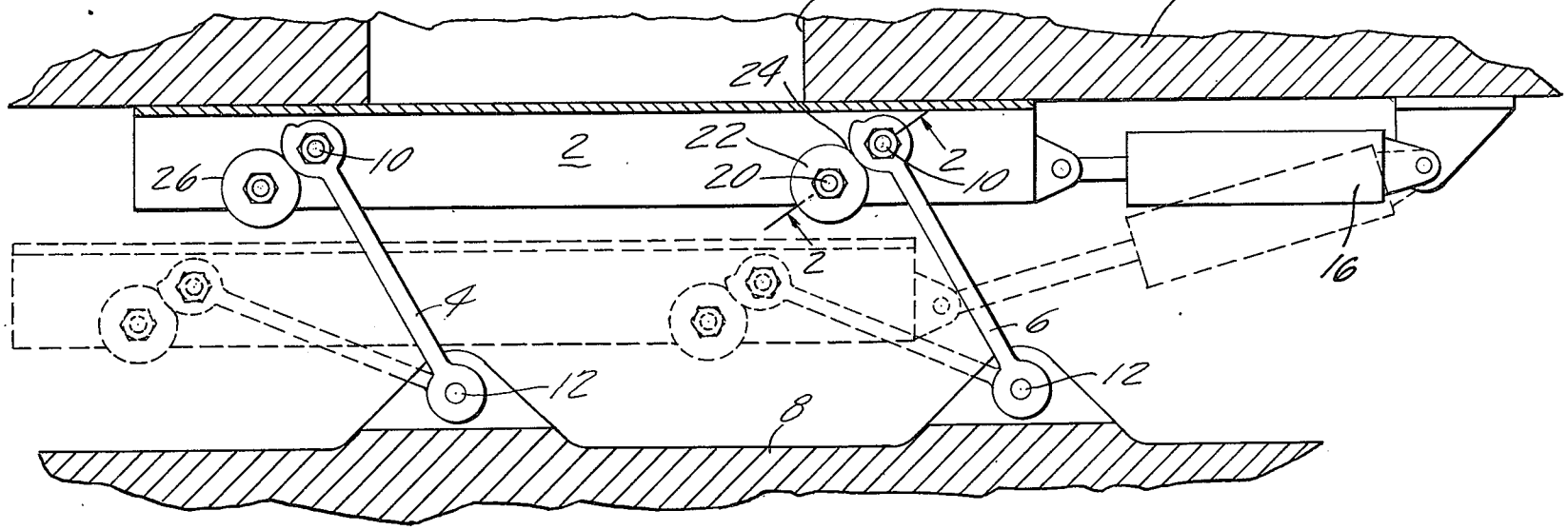
FIG. 1 is a plan view of a device embodying the invention.
Figure 2:
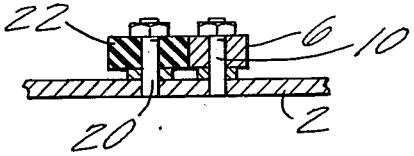
FIG. 2 is an enlarged sectional view along line 2—2 of FIG. 1.

As shown, the mechanism includes an actuated device 2 in the form of a plate supported by parallel links 4 and 6 from base member 8. The links 4 and 6 are mounted on spaced pins 10 on the device 2 and other pins 12 on the base member. This arrangement assures a movement of the device bodily toward or away from a support 14 against which the device 2 engages when in operative position. A suitable actuator 16 may be used for movement of the device 2 into and out of operative position.

This form of mechanism may have many uses. One particular utility may be in an axial flow compressor where bleeding of the compressor at a selected stage is controlled by moving the plate or device 2 away from a bleed opening 18 in the support 14, the latter in this environment being a part of the compressor casing. In such an environment the mechanism is subject to vibration.

The present invention is intended to prevent the vibration present in the device from causing such rattling as to cause undesired wear on the mechanism. To this end the plate 2 has a supporting pin 20 for a compressible resilient roller 22. This pin is parallel to the pin 10 for the link 6 and so located as to hold the periphery of the roller 22 against an external surface 24 on the link. This surface is eccentric to the pivot pin 10 and so positioned that the eccentricity increases in a direction opposite to the direction of movement of the link about the pin as the plate 2 is moved toward inoperative position. Thus as shown, the link 6 is moved counterclockwise as the plate moves toward inoperative position (away from the support) and thus the eccentricity of the surface increases, in the area contacting the roller, in a clockwise direction.

The result of this arrangement is that the resiliency of the roller applies a load laterally against the link to hold it against the supporting pin and prevent any rattling of the link on the pin. Since the eccentric surface increases the compression of the roller as the link moves toward inoperative position, there is an increasing pressure on the link and thus a force tending to move the plate 2 toward operative position. This action may serve instead of a spring as an actuating force to move the links and the associated plate toward operative position.

Another compressible roller 26 is shown in a similar arrangement acting on an eccentric surface on link 4 and thus preventing rattling of this link. These rollers also serve to prevent rattling at the other ends of the link since they apply a clockwise turning movement on the link and thus a lateral force between the link and the pins 12. For more anti-rattling additional compressible rollers could be mounted on the support 14 in the same manner as the roller 22 to act on the support end of the links 4 and 6.

The rollers may be any suitable compressible material. For example, some rubber compounds could be used, or, in other environments nylon or teflon rollers would be better. It is essential that the material have adequate wear characteristics and adequate compression characteristics to apply the desired load to accomplish the purpose with adequate durability.

Although the invention has been shown and described with respect to a preferred embodiment thereof, it should be understood by those skilled in the art that other various changes and omissions in the form and detail thereof may be made therein without departing from the spirit and scope of the invention.

Having thus described a typical embodiment of my invention, that which I claim as new and desire to secure by Letters Patent of the United States is:

1. An anti-rattling device for a linkage including:
- a pivoted arm forming part of the linkage,
- a member on which the arm is pivoted, and
- a compressible roller also mounted on the member adjacent to the arm and engaging the latter on an external surface surrounding the pivot point.

2. A device as in claim 1 in which the external surface is a cam surface surrounding the pivot point and eccentric thereto.

3. A device as in claim 1 including spaced parallel pins on the member, on one of which the arm is pivoted and the other of which supports the roller.

4. An anti-rattling device including:
- a fixed member,
- a movable member in parallel relation to the fixed member and movable toward and away from the fixed member,
- parallel links connecting the members to maintain the parallel relation, said links being pivoted to both members, and
- a compressible roller mounted adjacent to one end of at least one of said links and engageable with an external surface of the associated link.

5. A device as in claim 4 in which the external surface is a cam surface surrounding the pivot point of the adjacent link.

6. A device as in claim 4 including spaced parallel pins on the movable member, on one of which the roller is mounted and on the other of which the adjacent end of the link is pivoted.

7. A device as in claim 6 in which the cam surface is eccentric to the pivot axis of the link.

* * * * *